US010335933B2

(12) United States Patent
Michas

(10) Patent No.: US 10,335,933 B2
(45) Date of Patent: Jul. 2, 2019

(54) ADJUSTABLE SOCKET WRENCH

(71) Applicant: Luke William Michas, Hendersonville, TN (US)

(72) Inventor: Luke William Michas, Hendersonville, TN (US)

( * ) Notice: Subject to any disclaimer, the term of this patent is extended or adjusted under 35 U.S.C. 154(b) by 0 days.

(21) Appl. No.: 15/092,273

(22) Filed: Apr. 6, 2016

(65) Prior Publication Data

US 2016/0288303 A1 Oct. 6, 2016

Related U.S. Application Data

(60) Provisional application No. 62/143,257, filed on Apr. 6, 2015.

(51) Int. Cl.
*B25B 23/00* (2006.01)
*B25B 13/46* (2006.01)
*B25B 13/48* (2006.01)

(52) U.S. Cl.
CPC ..... *B25B 23/0028* (2013.01); *B25B 13/463* (2013.01); *B25B 13/481* (2013.01)

(58) Field of Classification Search
USPC ..... 81/60, 124.5, 63.2, 177.75
See application file for complete search history.

(56) References Cited

U.S. PATENT DOCUMENTS 5,630,342 A * 5/1997 Owoc ..... B25B 13/461 81/177.75
8,312,794 B2 * 11/2012 Hobden ..... B25B 13/465 81/124.5
9,114,509 B2 * 8/2015 Lovely ..... B25B 13/463
2011/0017024 A1 * 1/2011 Kriz ..... B25B 13/06 81/60

* cited by examiner

*Primary Examiner* — Joseph J Hail
*Assistant Examiner* — Shantese McDonald
(74) *Attorney, Agent, or Firm* — Hornkohl Intellectual Property Law, PLLC; Jason L. Hornkohl

(57) ABSTRACT

An adjustable wrench provides a drive head that rotates about two axis with respect to a drive gear. The wrench includes a wrench casing having an orbital cavity. A drive head, drive gear, pawl gear and an axis pin bushing are positioned in the orbital cavity. A drive head axis pin connects the drive head to the axis pin bushing such that the drive head can rotate about a first axis with respect to the drive gear. A drive gear axis pin connects the drive gear to the axis pin bushing such that the drive head can rotate about at second axis with respect to the drive gear. The pawl gear and drive gear rotate the drive head about a third axis with respect to the wrench casing.

9 Claims, 5 Drawing Sheets

ADJUSTABLE SOCKET WRENCH

CROSS-REFERENCES TO RELATED APPLICATIONS

The present Utility Patent Application is based upon and claims priority from U.S. Provisional Patent Application No. 62/143,257 filed Apr. 6, 2015 entitled "Adjustable Socket Wrench".

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The placement of bolts and other fasteners that require the use of a socket wrench are often mounted at a variety of different angles that make it difficult or impossible to turn the wrench for a variety of reasons. Current socket wrenches have fixed perpendicular angles between the handle and drive head. Even when at a small angle to the axis of a bolt these socket wrenches become difficult or impossible to use. The more obscure the angle of the bolt, the less effective these socket wrenches become. Current solutions require the use of an angle adapter but those are limited in angle adjustment, do not automatically adjust and extend the length of the drive shaft making them difficult to use in tight spaces. Therefore, what is needed is an improved socket wrench.

BRIEF SUMMARY OF THE INVENTION

An adjustable wrench constructed in accordance with an embodiment of the present invention includes a wrench casing having an orbital cavity. A drive head, drive gear, pawl gear, and axis pin bushing are positioned in the orbital cavity. The pawl gear works in connection with the drive gear to provide rotation of the drive head about an axis with respect to the wrench casing and provide the ratcheting action for the adjustable wrench. At least one drive head axis pin connects the drive head to the axis pin bushing such that the drive head can rotate on a first axis with respect to the drive gear. At least one drive gear axis pin connects the drive gear to the axis pin bushing such that the drive head can rotate about a second axis with respect to the drive gear. The drive head has a slot that receives the axis pin bushing and openings that receive the drive head axis pins. The axis pin bushing includes an opening that receives the drive head axis pin and an opening that receives the drive gear axis pin. The drive gear preferably has an angled upper edge that facilitates movement of the drive head with respect to the wrench casing.

DETAILED DESCRIPTION OF THE INVENTION

Figure 1:
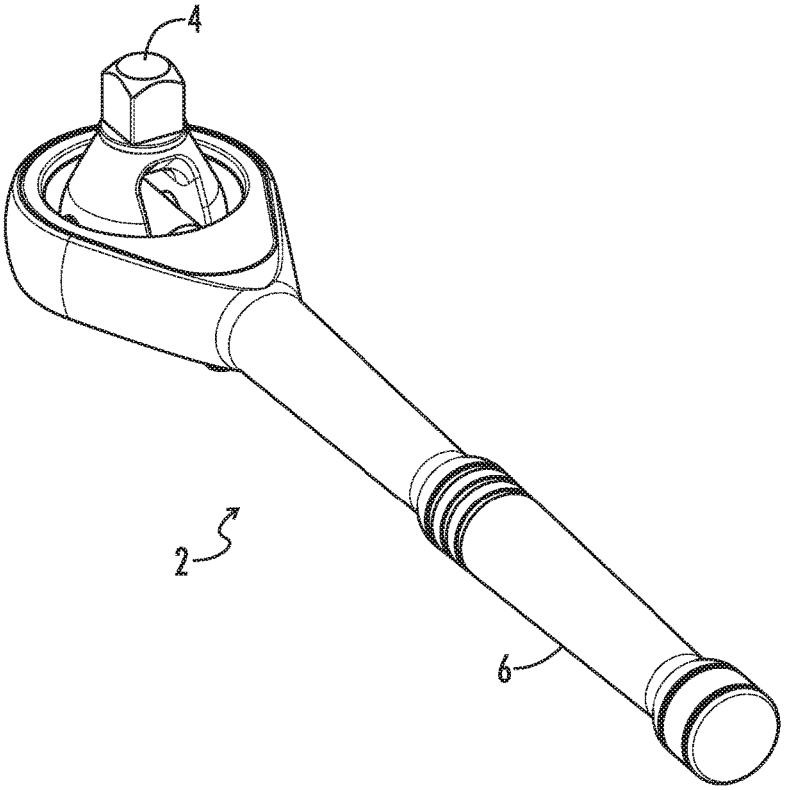
FIG. 1 is an illustration of an adjustable wrench constructed in accordance with an embodiment of the present invention.

The present invention improves upon prior socket wrenches by offering a compact drive mechanism that allows the drive shaft to rotate and be at various compound angles relative to three separate planes as well as the handle that is driving it. Referring now to FIG. 1, an illustration of an adjustable wrench 2 constructed in accordance with an embodiment of the present invention is shown. The orbital drive head 4 of the present invention allows the axis of the turning head 4 to be independent from the axis or plane of the handle or wrench casing 6 facilitating the turning of bolts at odd compound angles. The wrench 2 is adjustable because it has a compact drive mechanism that allows the drive shaft and head 4 to be at various angles relative to the wrench casing 6 that is driving it. It does this with no secondary attachments and automatically adjusts to the best angle within a given range. The maximum angle of deviation for the drive head 4 of the embodiment shown in any one plane is 45 degrees from dead center, dead center being the axis of the head 4 at 90 degrees to the handle of the casing 6.

Figure 2:
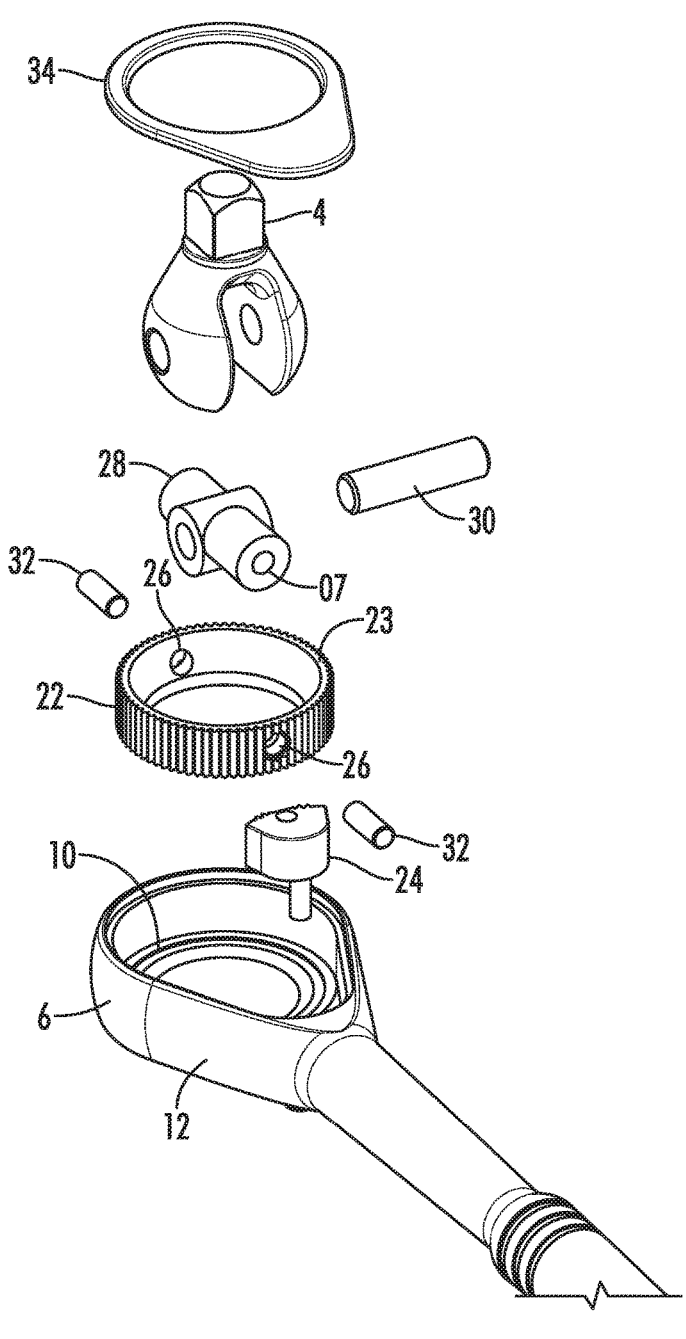
FIG. 2 is an exploded view of the adjustable wrench of FIG. 1.

Referring now to FIG. 2, an exploded view of the adjustable wrench of FIG. 1 is shown. The wrench casing 6 is preferably made from metal and machined. The head 12 of the casing 6 creates an orbital pocket 10, like an eye ball socket, for the drive head 4, drive head axis pin 30, drive gear axis pins 32, axis pin brushing 28, drive gear 22 and pawl gear 24 to nest into.

The drive head 4 is a socket head driver with a shape similar to the eye ball of a ball and socket joint. The shape of the drive head 4 allows the same amount of clearance in compound angles between the other components of the assembly. The drive head 4 is positioned concentric to the wrench housing orbital pocket 10 in the head 12 of the wrench casing 6. The drive head 4 includes a slot that receives the axis pin bushing 28 so that the axis pin bushing 28 can rotate with respect to the drive head 4.

The drive gear 22 provides rotation about an axis with respect to the wrench easing and the ratcheting gearing found in typical socket wrenches when used in conjunction with the pawl gear 24. The drive gear 22 is angled at the top edge 23 in such a way as to allow clearance for the drive head 4 to turn while at its maximum compound angle with no interference. The drive gear 22 also provides axis pivot mounting holes 26 to allow the drive head 4 assembly to be assembled and pivot in one plane or axis.

The axis pin bushing 28 has openings 27 that allow it to connect to the drive gear 22 allowing it to rotate about one axis. The axis pin bushing also has openings 29 that allow it to connect to the drive head 4 allowing it to rotate in a second axis at the same time. This provides the wrench the ability to have compound angles of up to 90 degrees in any direction at the same time. In addition, the drive gear 22 and drive head 4 rotate about a third axis with respect to the wrench casing 6.

The drive head axis pin 30 connects the drive head 4 to the axis pin bushing 28 allowing the drive head 4 to rotate about the axis of the drive head axis pin 30. Drive gear axis pins 32 connect the drive gear 22 to the axis in bushing 28 allowing the drive head 4 to rotate about the axis of the pins 32.

A retaining plate 34 keeps the assembled orbital drive sub assembly secured in the wrench casing 6.

The axis pin bushing 28 and drive head 4 are preferably constructed using computer numerically controlled machining to get exact tolerances and shapes. A less expensive die casting process can be used but it may yield surfaces that are more inconsistent in shape when measured resulting in binding up and jamming.

Figure 3:
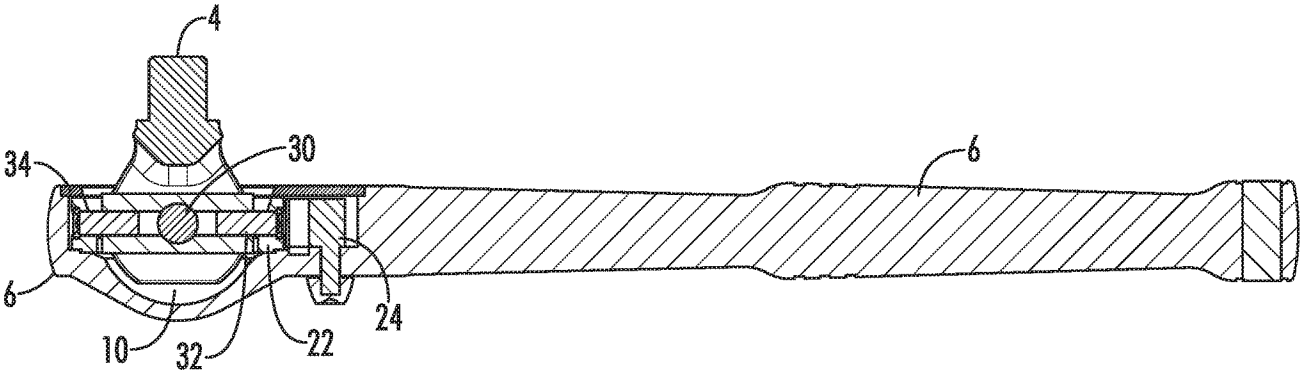
FIG. 3 is a cross sectional side view of the adjustable wrench of FIG. 1.
Figure 4:
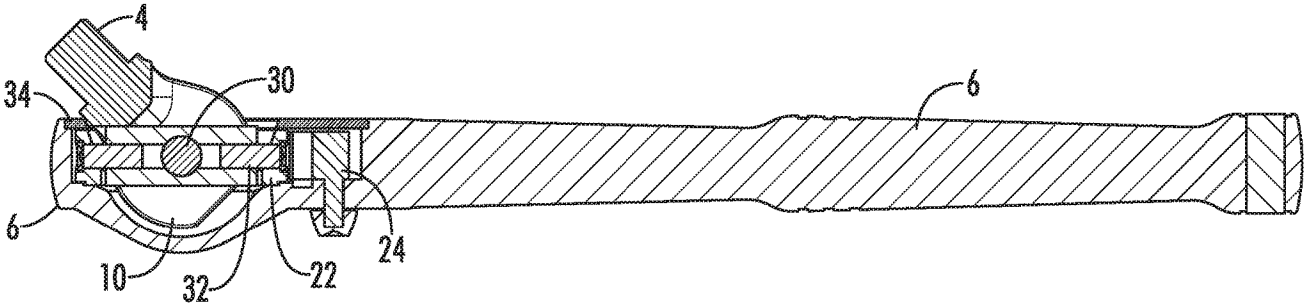
FIG. 4 is a cross sectional side view of the adjustable wrench of FIG. 1 showing the drive head in an angled position with respect to the wrench casing.

Referring now to FIG. 3, a cross-sectional view of the adjustable wrench of FIG. 1 is shown. The drive head 4 is positioned inside the orbital cavity 10 of the head of the wrench casing 6. The drive head 4 rotates along the axis of the drive head axis pin 30 and the drive gear axis pin 32 providing two-axis of rotation for the drive head 4. The drive gear 22 and pawl gear 24 work together to provide rotation about a third axis in a typical wrench ratcheting action. The retaining plate 34 holds the drive head 4 and associated assembly in the orbital cavity 10 of the wrench casing 6. FIG. 4 is a cross sectional side view of the adjustable wrench showing the drive head 4 in an angled position with respect to the wrench casing 6.

Figure 5:
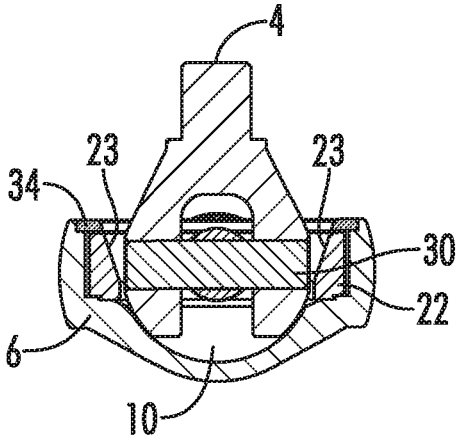
FIG. 5 is a cross sectional top view of the adjustable wrench of FIG. 1.
Figure 6:
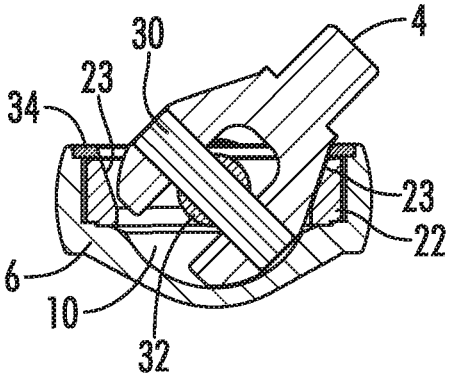
FIG. 6 is a cross sectional top view of the adjustable wrench of FIG. 1 showing the drive head in an angled position with respect to the wrench casing.

FIG. 5 is a cross sectional top view of the adjustable wrench of FIG. 1 and FIG. 6 is a cross sectional top view showing the drive head 4 in an angled position with respect to the wrench casing 6. The angled top edge 23 of the drive gear 22 facilitates movement of the drive head 4.

Figure 7A:
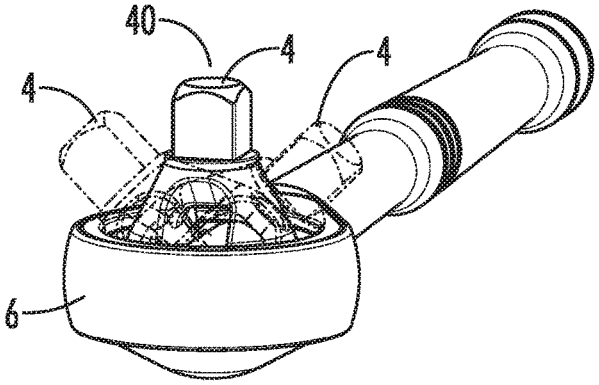
FIGS. 7(A) and 7(B) are illustrations of the adjustable wrench of FIG. 1 that depict the range of movement of the drive head.
Figure 7B:
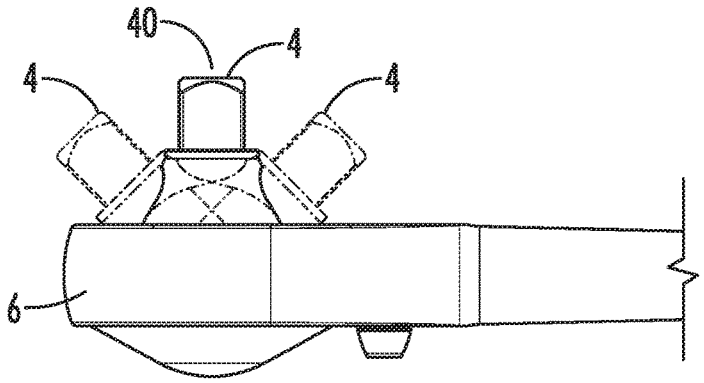

FIGS. 7(A) and 7(B) are illustrations of the adjustable wrench of FIG. 1 that depict the range of movement of the drive head. In the embodiment shown, the drive head 4 is capable of moving 45 degrees from its center position 40 in any direction and rotating with respect to the wrench casing 6.

Although there have been described particular embodiments of the present invention of a new and useful Adjustable Socket Wrench, it is not intended that such references be construed as limitations upon the scope of this invention except as set forth in the following claims.

I claim:

1. An adjustable wrench, said adjustable wrench comprising:

a wrench casing that forms an orbital cavity said orbital cavity comprising a pocket with a curved or rounded lower interior surface;

a drive head positioned in said orbital cavity such that a portion of said drive head is concentric to said curved or rounded lower interior surface of said orbital cavity formed in said wrench casing;

a drive gear;

a pawl gear;

an axis pin bushing;

at least one drive head axis pin that connects said drive head to said axis pin bushing such that said drive head can rotate about a first axis with respect to said wrench casing;

at least one drive gear axis pin that is mounted in a hole in said drive gear that connects said drive gear to said axis pin bushing such that said drive head can rotate about a second axis with respect to said wrench casing; and a retaining plate that holds said drive head in said orbital cavity in said wrench casing.

2. The adjustable wrench of claim 1 wherein said pawl gear works in connection with said drive gear to rotate said drive head about a third axis with respect to said wrench casing.

3. The adjustable wrench of claim 1 wherein said drive gear further comprises an angled upper edge that allows movement of said drive head with respect to said wrench casing.

4. The adjustable wrench of claim 1 wherein said drive head further comprises a slot that receives said axis pin bushing.

5. The adjustable wrench of claim 1 wherein said drive head further comprises openings that receive said drive head axis pin.

6. The adjustable wrench of claim 1 wherein said axis pin bushing further comprises an opening that receives said drive head axis pin.

7. An adjustable wrench, said adjustable wrench comprising:

a wrench casing having an orbital cavity formed by the wrench casing said orbital cavity comprising a pocket with a curved or rounded lower interior surface;

a drive head positioned in said orbital cavity such that a portion of said drive head is concentric to said curved or rounded lower interior surface of said orbital cavity formed in said wrench casing;

a drive gear;

an axis pin bushing;

at least one drive head axis pin that connects said drive head to said axis pin bushing such that said drive head can rotate about a first axis; and at least one drive gear axis pin that is inserted into a hole in said drive gear to connect said drive gear to said axis pin bushing such that said drive head can rotate about a second axis.

8. The adjustable wrench of claim 7 further comprising a retaining plate that holds said drive head in said orbital cavity in said wrench casing.

9. The adjustable wrench of claim 7 further comprising a pawl gear that works in connection with said drive gear to rotate said drive head about a third axis.

* * * * *